US009011645B2

(12) United States Patent
Ryan et al.

(10) Patent No.: US 9,011,645 B2
(45) Date of Patent: Apr. 21, 2015

(54) METHOD FOR PREPARING A SEAM AREA FOR A PMC BASE FABRIC

(75) Inventors: Matthew Ryan, Appleton, WI (US); Susanne Klaschka, Nuremberg (DE); Barbara Elmer, Menasha, WI (US)

(73) Assignee: Voith Patent GmbH, Heidenheim (DE)

( * ) Notice: Subject to any disclaimer, the term of this patent is extended or adjusted under 35 U.S.C. 154(b) by 256 days.

(21) Appl. No.: 13/606,456

(22) Filed: Sep. 7, 2012

(65) Prior Publication Data

US 2014/0069549 A1 Mar. 13, 2014

(51) Int. Cl.

| | |
|---|---|
| ***D21F 1/10*** | (2006.01) |
| ***D21F 7/10*** | (2006.01) |
| ***D21F 7/08*** | (2006.01) |
| ***D21F 7/12*** | (2006.01) |
| ***D21F 1/00*** | (2006.01) |

(52) U.S. Cl.

CPC ..... *D21F 1/0054* (2013.01); *D21F 7/08* (2013.01); *D21F 1/0036* (2013.01); *D21F 7/10* (2013.01); *D21F 7/12* (2013.01); *Y10S 162/90* (2013.01); *Y10S 162/902* (2013.01); *Y10S 162/903* (2013.01); *Y10S 162/904* (2013.01)

(58) Field of Classification Search

CPC ... D21F 1/0054; D21F 1/0036; D21F 1/0045; D21F 1/0027; D21F 1/10; D21F 1/12; D21F 1/16; D21F 7/08; D21F 7/083; D21F 7/10; D21F 7/12; D03D 3/04; D03D 11/00; D03D 15/00; D03D 15/0094; D03D 15/0027

USPC ..... 162/348, 358.2, 900, 902–904; 139/383 A, 383 AA, 425 A; 428/58

See application file for complete search history.

(56) References Cited

U.S. PATENT DOCUMENTS

| | | | | |
|---|---|---|---|---|
| 5,476,123 | A | 12/1995 | Rydin | |
| 7,135,093 | B2 * | 11/2006 | Gstrein | 162/358.2 |
| 2009/0211722 | A1 * | 8/2009 | Crook et al. | 162/358.4 |
| 2010/0059135 | A1 * | 3/2010 | Ogiwara | 139/383 AA |
| 2012/0135184 | A1 * | 5/2012 | Lang | 428/99 |

FOREIGN PATENT DOCUMENTS

| | | | |
|---|---|---|---|
| WO | 8912717 | A1 | 12/1989 |
| WO | WO 89/12717 | * | 12/1989 |

* cited by examiner

*Primary Examiner* — Eric Hug
(74) *Attorney, Agent, or Firm* — Taylor IP, P.C.

(57) ABSTRACT

A process for preparing a seam area for a paper machine clothing (PMC) base fabric includes the steps of: forming the PMC base fabric by flat-weaving, the PMC base fabric including warp yarns extending in machine direction and weft yarns extending in cross machine direction and interwoven with the warp yarns, the weft yarns including first weft yarns and a second weft yarn, the second weft yarn being a multifilament yarn, the warp yarns, the first weft yarns, and the multifilament yarn being woven together on a loom in an original weaving process, the multifilament yarn being positioned in an anticipated seam area; and folding over the PMC base fabric, after weaving the multifilament yarn with the warp yarns, to form a seam loop of the PMC base fabric such that the multifilament yarn is a first one of the weft yarns on a sheet side of the seam loop.

17 Claims, 5 Drawing Sheets

METHOD FOR PREPARING A SEAM AREA FOR A PMC BASE FABRIC

BACKGROUND OF THE INVENTION

1. Field of the Invention

The present invention relates to paper machine clothing, and, more particularly, to a method for preparing a seam area for the clothing in an endless manner.

2. Description of the Related Art

A paper machine clothing (PMC) base fabric is typically manufactured with a specific set of design and quality specifications for a particular paper machine's performance requirements. These specifications include surface characteristics, open area, void volume, permeability and smoothness, among others.

A woven PMC base fabric can be woven "endless". The fabric produced by this method can be referred to as a circular (or round) woven endless fabric. Alternatively, a woven PMC base fabric can be woven "flat", and the free ends can then be joined. The fabric produced by this method can be referred to as a flat-woven fabric.

It is known to manufacture a woven press fabric having a flat-woven base fabric with a plurality of warp yarns forming seam loops along the ends of the fabric extending in a cross machine direction (CD), transverse to the machine direction (MD). The ends are then placed in end-to-end disposition in order to interdigitate the loops and a pintle wire is then inserted in the interdigitated loops to lock the ends together to bring the fabric into an endless form. For installation in a paper machine of the like, the two ends are separated such that the fabric can be pulled in its direction of movement into the machine, after which the two belt longitudinal ends can then be joined together again. The region of the seam in this case has a larger void area than the rest of the fabric, resulting in a differential dewatering in this area which may lead to marking of the fibrous web. In addition, the formation of seam loops on the base fabric results in increased production time and expense.

PCT Intl. App. No. PCT/GB89/00681 discloses a seam for a PMC base fabric in which a number of weft yarns are removed from the fabric at a fold location. The fabric is folded over at the fold location, sewed adjacent the fold location, interdigitated with loops from an adjacent fabric end, and a pintle wire is inserted through the interdigitated loops.

Further, experience has shown that the addition of a multifilament yarn in a seam zone (before the first CD yarn on the sheet side as disclosed in U.S. Pat. No. 5,476,123 (Rydin)) reduces sheet marking and improves seam durability. This method and more recent modifications work on circular woven endless base fabrics. It is thus known to add a multifilament yarn during an original circular weaving process on a loom.

Further, it is known to add a multifilament yarn to the seam after weaving by various methods for flat-woven base fabrics which are then converted into a laminate seam fabric. However, adding the multifilament yarn after weaving is time-consuming.

What is needed in the art is an improved process for preparing a seam area for a PMC base fabric.

SUMMARY OF THE INVENTION

The present invention provides a process for preparing a seam area for a PMC base fabric, the PMC base fabric being a flat-woven fabric having a seam area having at least one multifilament yarn or, more generally, at least one specialty yarn on the sheet side of the seam loop, the multifilament yarn or specialty yarn being inserted as a weft yarn when the base fabric is flat-woven.

The invention in one form is directed to a process for preparing a seam area for a paper machine clothing (PMC) base fabric, the process including the steps of: forming the PMC base fabric by flat-weaving, the PMC base fabric including a plurality of warp yarns extending in a machine direction and a plurality of weft yarns extending in a cross machine direction and interwoven with the plurality of warp yarns, the plurality of weft yarns including a plurality of first weft yarns and at least one second weft yarn, the at least one second weft yarn being a multifilament yarn, the plurality of warp yarns, the plurality of first weft yarns, and the at least one multifilament yarn being woven together on a loom in an original weaving process, the at least one multifilament yarn being positioned in an anticipated the seam area; and folding over the PMC base fabric, after weaving the at least one multifilament yarn with the plurality of warp yarns, to form a seam loop of the PMC base fabric such that the at least one multifilament yarn is a first one of the plurality of weft yarns on a sheet side of the seam loop.

The invention in another form is directed to a process for preparing a seam area for a paper machine clothing (PMC) base fabric, the process including the steps of: forming the PMC base fabric by flat-weaving, the PMC base fabric including a plurality of warp yarns extending in a machine direction and a plurality of weft yarns extending in a cross machine direction and interwoven with said plurality of warp yarns, the plurality of weft yarns including a plurality of first weft yarns and at least one second weft yarn, the at least one second weft yarn being a specialty yarn, the plurality of warp yarns, the plurality of first weft yarns, and the at least one specialty yarn being woven together on a loom in an original weaving process, the at least one specialty yarn being at a position associated with an anticipated said seam area; and folding over the PMC base fabric, after weaving the at least one specialty yarn with the plurality of warp yarns, to form a seam loop of the PMC base fabric such that the at least one specialty yarn is at a position associated with the seam loop.

An advantage of the present invention is that it provides a method for manufacturing a seam felt from flat-woven single layer material that includes a multifilament yarn (or any specialty yarn) added during the weaving process in what will become the seam zone.

Another advantage is that the PMC base fabric can be used for forming a forming fabric, a press fabric, a dryer fabric, or other fabrics of a paper making machine.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
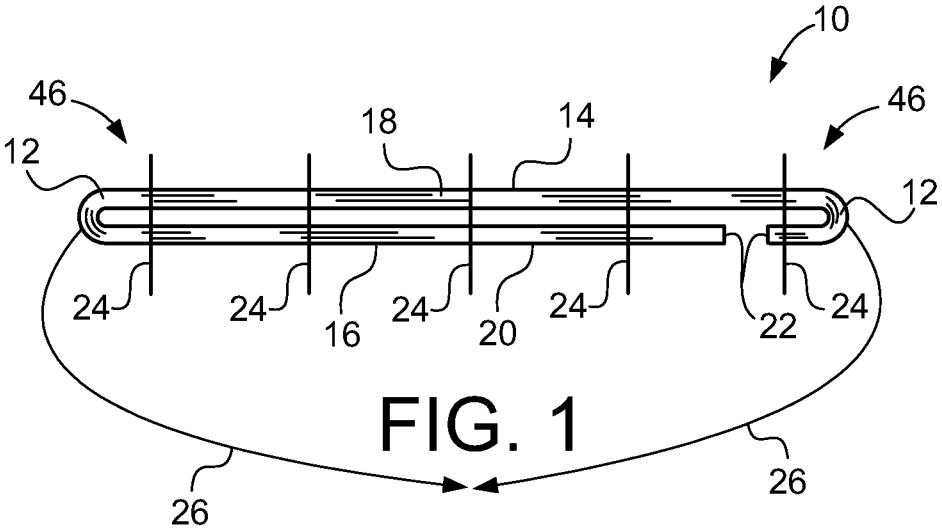
FIG. 1 is a schematic side view of a PMC base fabric according to the present invention.
Figure 2:
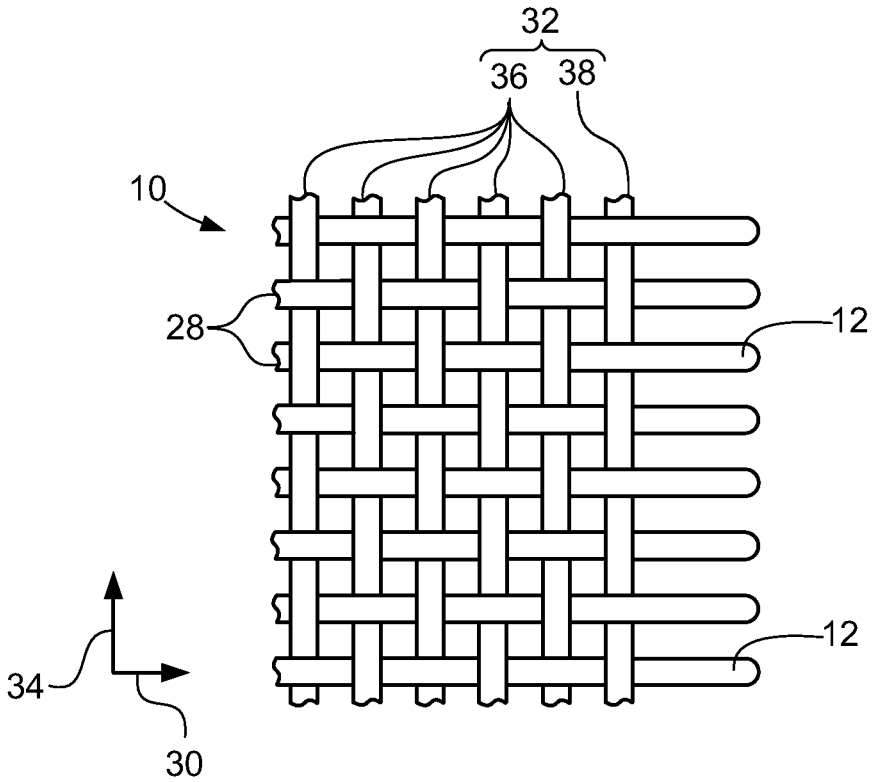
FIG. 2 is a top view of a portion of the PMC base fabric of FIG. 1.
Figure 3:
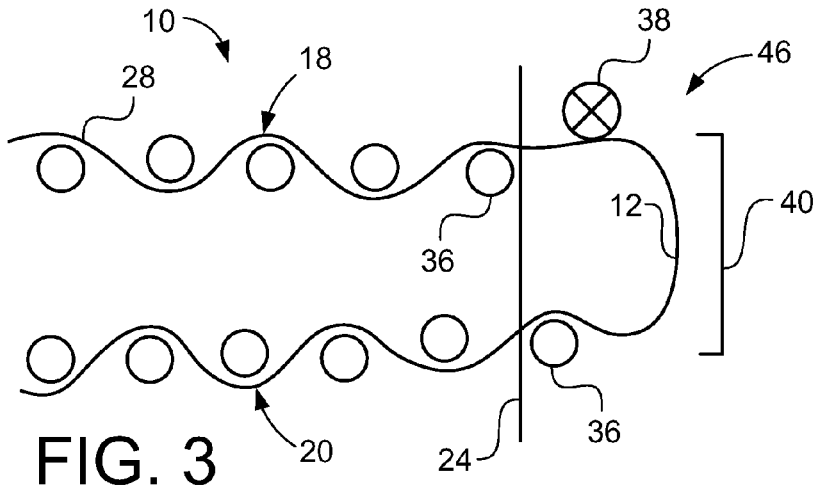
FIG. 3 is a side view of a portion of the PMC base fabric of FIG. 2.

Referring now to the drawings, and more particularly to FIGS. 1-3, there is shown schematically an embodiment of a flat-woven PMC base fabric 10 which generally includes two seam loops 12, a sheet side 14, a machine side 16, a top ply 18, a bottom ply 20, two free ends 22, and reinforcements 24. This embodiment of base fabric 10 is shown by way of example and not by way of limitation. Sheet side 14 is the side of base fabric 10 which faces the web of fibrous material (or a nascent such web)(not shown) when base fabric 10 is used in a paper making machine. Machine side 16 is the side of base fabric 10 which opposes sheet side 14 and engages components of the paper making machine (such as rollers). After the seam loops 12 are formed, the base fabric 10 has a top ply 18 and a bottom play 20, the top ply 18 being on the sheet side 14 and the bottom ply 20 being on the machine side 16 of the base fabric 10. The two free ends 22 are shown schematically as being separate from each other, but it is understood that free ends 22 can come together and be joined together. Free ends 22 are shown near one of the seam loops 12 and can be attached to top ply 18 very near one of seam loops 12. Depending upon the application of the base fabric 10, free ends 22 can be joined at any location along the longitudinal extent of the base fabric 10. Further, reinforcements 24 are shown in FIG. 1. Reinforcements 24 assist in securing bottom ply 20 to top ply 20 and can be placed at locations different from what is shown in FIG. 1. Arrows 26 in FIG. 1 show that seam loops 12 are to be brought together and seamed to form a belt by, at least in part, interdigitating the seam loops 12 of each end and inserting a pintle wire (not shown) through the tunnel (not shown) formed by the interdigitated seam loops 12. The specific configuration of base fabric 10 as shown in FIG. 1 may vary, depending upon the application. For example, the specific weave pattern of base fabric 10 may vary from one application to another.

Figure 11:
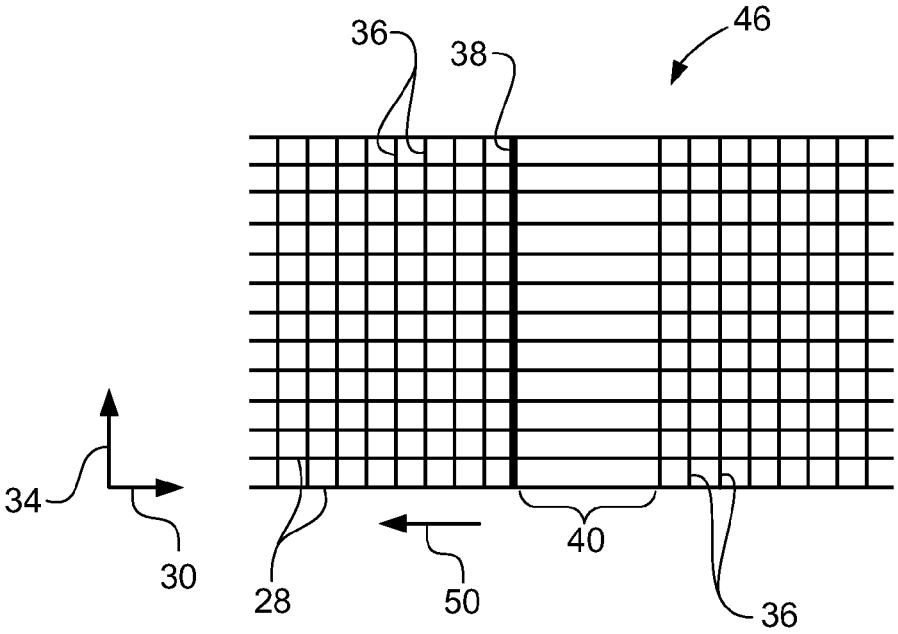
FIG. 11 is a top view of a portion of the PMC base fabric including an embodiment of a seam area of the present invention with a predetermined number of weft yarns removed to define a window of a folded area.

FIG. 2 shows schematically a top view (sheet side view) of top ply 18 of base fabric 10 shown in FIG. 1. FIG. 2 shows that base fabric 10 includes warp yarns 28 extending in a machine direction 30 and weft yarns 32 extending in a cross machine direction 34, the weft yarns 32 being interwoven with the warp yarns 28. FIG. 2 shows that the weft yarns 32 include first weft yarns 36 and at least one second weft yarn 38. Reference number 32 is a generic number used to refer to both first weft yarns 36 and second weft yarns 38. While FIGS. 2 and 11 show at least one second weft yarn 38, FIGS. 2 and 11 can be more broadly interpreted such that the schematically represented structure corresponding to reference number 38 actually refers to two or more second weft yarns 38; however, unless otherwise stated, it is assumed herein for purposes of discussion that FIGS. 2 and 11 show a single weft yarn 38 (which may or may not be formed as a cabled yarn). By way of example and not by way of limitation, first weft yarns 36 can be a plurality of monofilament yarns (which are not cabled and can otherwise be referred to as solid monofilament yarns) and/or a plurality of cabled monofilament yarns; by way of example and not by way of limitation, the body of base fabric 10 can be made entirely of cabled monofilament weft yarns 36. Second weft yarn 38 is a specialty yarn. By way of example and not by way of limitation, specialty yarn 38 can be formed by a multifilament yarn, which can be formed by a plurality of filaments that have been extruded together, a cabled monofilament yarn, a cabled multifilament yarn, a staple yarn, or a colored multifilament yarn; specialty yarn 38 can alternatively be formed by a colored monofilament yarn, which may or may not be a cabled yarn (if colored monofilament yarn is cabled then it would be a multifilament yarn). Other specialty yarns can be used. By way of a general definition, a specialty yarn can be defined as a yarn that is different from the body of the base fabric (i.e., base fabric 10), the body being formed of first weft yarns 36. Thus, for example, specialty yarn 38 may be a multifilament yarn while first weft yarns 36 are a monofilament yarn. However, by way of example, if first weft yarns 36 are cabled monofilament yarns, then specialty yarns 38 would not be cabled monofilament yarns (it is conceivable, though, that both weft yarns 36 and 38 could be cabled monofilament yarns if weft yarns 36 and 38 are different in material relative to one another). By way of another example, it is conceivable that if first weft yarns 36 are monofilament yarns which are not cabled, then specialty yarns 38 could be colored monofilament yarns which are not cabled if first weft yarns 36 are not colored monofilament yarns. A multifilament yarn 38, by way of example, can include a low melt, fusible component. Further, a cabled monofilament yarn referenced above, generally, can include several monofilaments (which may be deemed monofilament yarns) that have been twisted together to form a cabled yarn. Further, unless otherwise stated, it is assumed herein that first weft yarns 36 are monofilament yarns (which are not cabled) and that specialty yarns 38 are multifilament yarns 38; this is assumed by way of example and not by way of limitation and thus serves as an exemplary embodiment. Warp yarns 28 and/or weft yarns 32 may include any man-made material, such as nylon, polyester, or other types of poly-yarns. Multifilament yarns 38 can include polyamide as a primary material, or, alternatively, polyester as a primary material, or, alternatively, polyaramide as a primary material; these materials are listed by way of example and not by way of limitation (in other words, a different material can be used as the primary material of multifilament 38).

Figure 4:
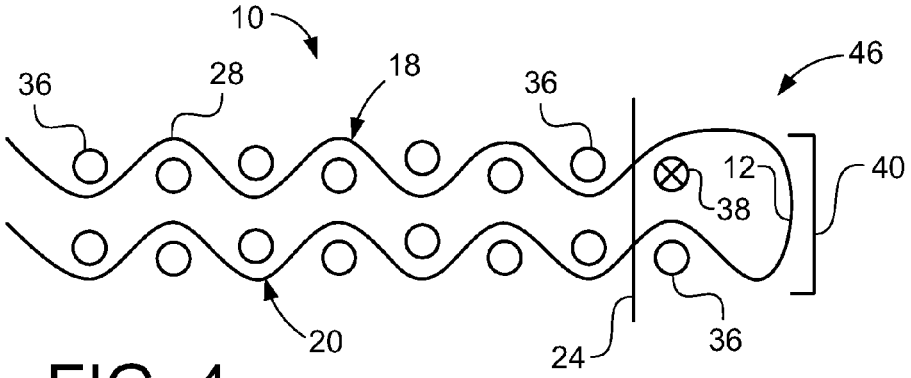
FIG. 4 is a side view of a portion of another embodiment of the PMC base fabric of FIG. 1.
Figure 5:
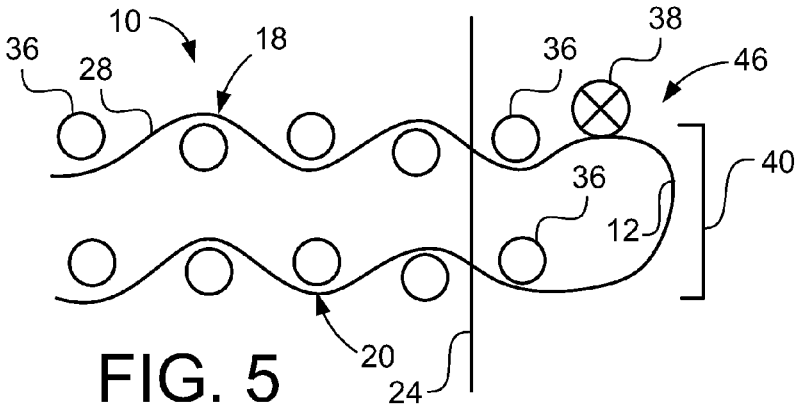
FIG. 5 is a side view of a portion of another embodiment of the PMC base fabric of FIG. 1.
Figure 6:
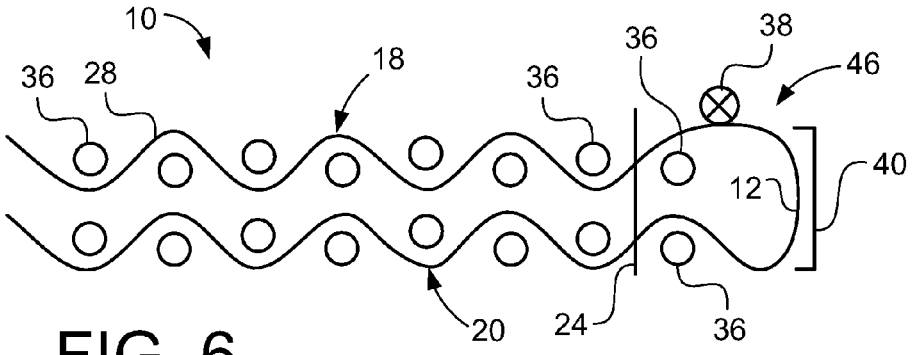
FIG. 6 is a side view of a portion of another embodiment of the PMC base fabric of FIG. 1.
Figure 7:
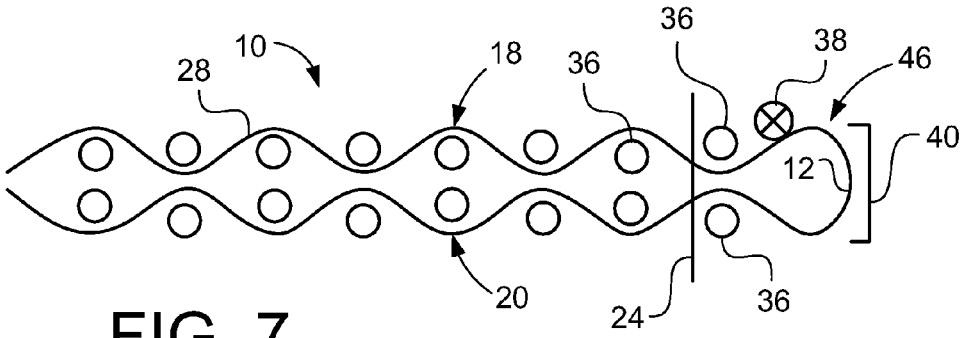
FIG. 7 is a side view of a portion of another embodiment of the PMC base fabric of FIG. 1.

FIGS. 3-8 show side views of various embodiments of the seam area 46. FIGS. 3-8 show multifilament yarn 38 with an X within a circle and the monofilament yarns 36 as a circle without an X therein. FIG. 3 shows a side view of the base fabric 10 of FIGS. 1 and 2. Base fabric 10 has been folded to form a seam loop 12, this seam loop 12 being where an opposing end of base fabric 10 is interdigitated with the seam loop 12 shown in FIG. 3. Seam loop 12 includes an area (described as a window 40 below) having an absence of weft yarns 32. Multifilament yarn 38 is shown on the sheet side 14 of top ply 18 of base fabric 10. Further, a reinforcement 24, such as seam stitching 24, is shown in FIG. 3. FIGS. 4-8 each show a side view of the base fabric 10 according to the schematic drawing provided in FIG. 1. In general, FIGS. 3-8 show different weave patterns. FIG. 4 shows multifilament yarn 38 placed inside seam loop 12 from this viewpoint and is still considered to be placed on the sheet side 14 of seam loop 12; for, multifilament yarn 38, as it weaves with warp yarn 28, will weave over a warp yarn 28 as multifilament yarn 38 extends into the page of FIG. 4. Further, the weave pattern of the top ply 18 in FIG. 5 is different than that shown in FIG. 3. Further, the seam reinforcement 24, such as the seam stitching 24, nearest seam loop 12 in FIG. 5 is placed in a different location than that shown in FIG. 3. Thus, reinforcement 24 in FIGS. 3 and 4 are essentially in the same place relative to one another, and reinforcement 24 in FIGS. 5-8 are essentially in the same place relative to one another.

Figure 9:
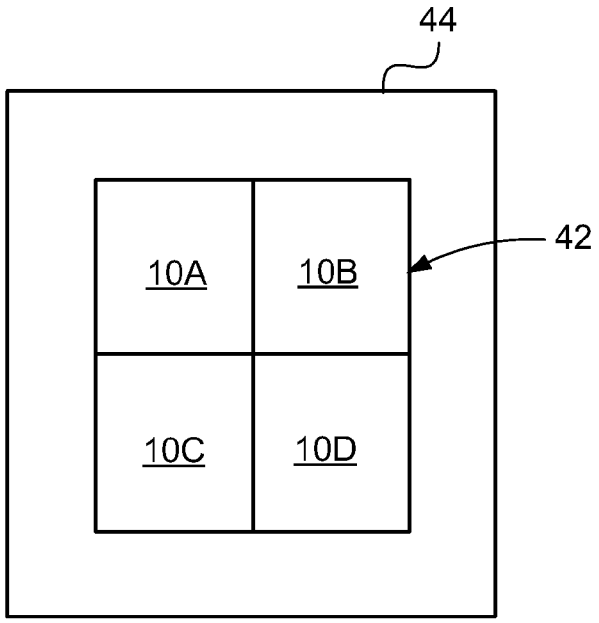
FIG. 9 is a schematic drawing of the loom and mother fabric.

FIG. 9 shows a schematic diagram of the formation of a mother fabric 42 which includes a plurality of child fabrics 10A, 10B, 10C, and 10D used to form the PMC base fabric 10. Mother fabric 42 is woven on a loom 44 used for flat-weaving a fabric, and mother fabric 42 is thus also a flat-woven fabric.

PMC base fabric is formed by the process according to the present invention. The present invention provides a process for preparing a seam area 46 for PMC base fabric 10. The method includes the steps of: forming base fabric 10 by flat-weaving (fabric 10 thus being a flat-woven fabric), fabric 10 including a plurality of warp yarns 28 extending in machine direction 30 and a plurality of weft yarns 32 extending in cross machine direction 34 and interwoven with warp yarns 38, weft yarns 32 including a plurality of first weft yarns 36 and at least one second weft yarn 38, second weft yarn 38 being a multifilament yarn 38, warp yarns, first weft yarns 36, and said multifilament yarn 38 being woven together on loom 44 in an original weaving process, multifilament yarn 38 being positioned in an anticipated seam area 46; and folding over fabric 10, after weaving multifilament yarn 38 with warp yarns 28, to form seam loop 12 of PMC base fabric 10 such that multifilament yarn 38 is a first one of weft yarns 32 on sheet side 14 of seam loop 12.

Prior to the step of folding, fabric 10 can be a single-layered fabric (fabric 10 being formed from a single-layered mother fabric 42), as indicated in FIGS. 3-8 by the single layer of weft yarns 32 in top ply 18 prior to folding bottom ply 20 under top ply 18. Alternatively, fabric 10 can have a plurality of layers (that is, a plurality of weft yarn layers) prior to the folding step. Further, prior to the step of folding, base fabric 10 can be cut from mother fabric 42.

Figure 10:
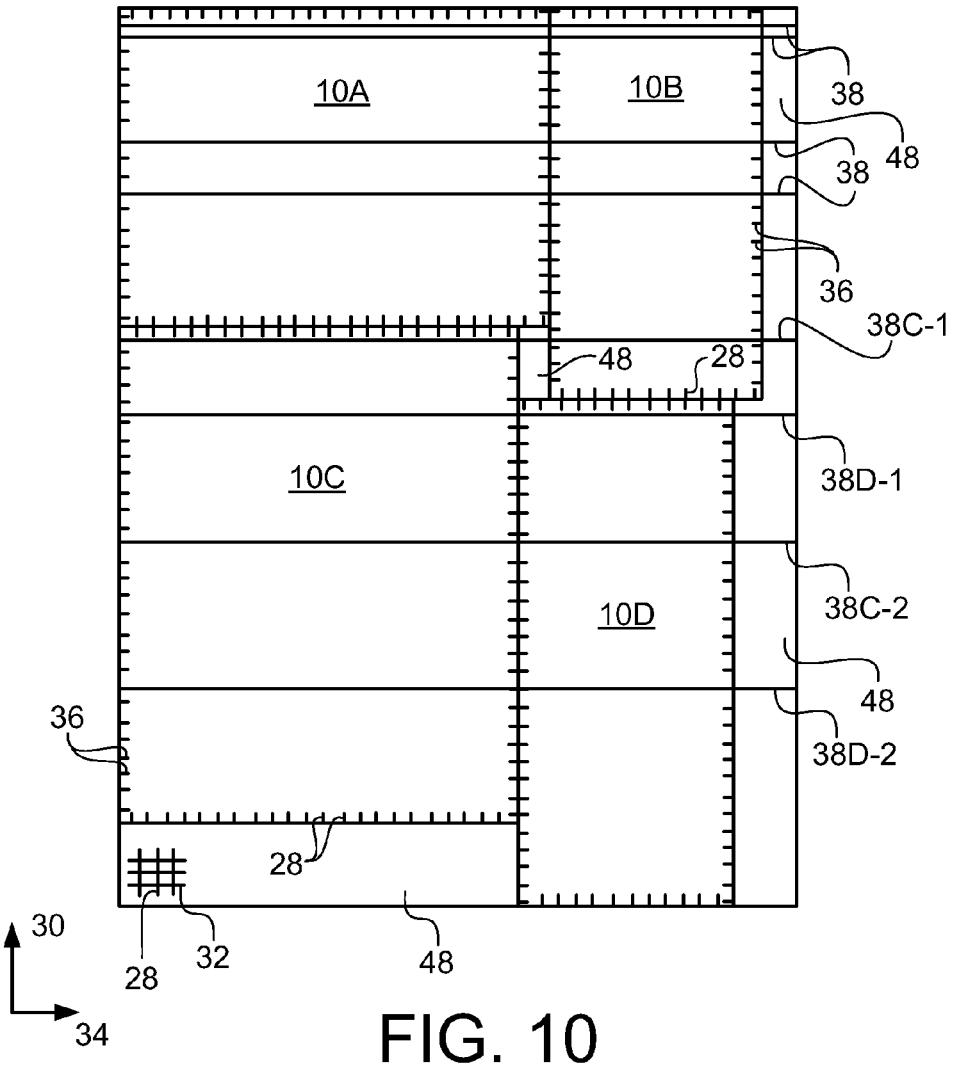
FIG. 10 is a top view of the mother fabric.

Further, FIG. 10 shows a schematic diagram of a sheet side 14 of mother fabric 42 extending longitudinally in machine direction 30 and transversely in cross machine direction 34. Mother fabric 42 can be wound on a roll to form a mother roll. The free end of the mother roll 42 (the free end of mother roll 42 being near the top of the page of FIG. 10) can be pulled and then one or more child fabrics 10A, 10B, 10C, 10D can be cut from mother fabric 42 to form an individual PMC base fabric 10. Thus, PMC base fabric 10 is a respective child fabric formed from mother fabric 42. For ease of distinguishing one child fabric from another, the four PMC base fabrics 10 in FIGS. 9 and 10 have been labeled as fabrics 10A, 10B, 10C, and 10D. Thus, fabric 10 is a child fabric 10 formed from a flat-woven mother fabric 42 which includes a plurality of child fabric 10 (specifically, child fabrics 10A, 10B, 10C, and 10D in FIGS. 9 and 10) for forming individual ones of the PMC base fabric 10. Mother fabric 42 thereby includes a plurality of multifilament yarns 38 interwoven during the original weaving process. "Original weaving process" refers to the weaving of the warp and weft yarns 28, 32 (including monofilaments yarns 36 and multifilament yarns 38) on the loom 44 used for flat-weaving. Thus, multifilament yarns 38 are not added to the mother fabric 42 or any of the child fabrics 10A, 10B, 10C, 10D after removing mother fabric 42 from loom 44 but are rather woven as part of mother fabric 42 like the other weft yarns 36; monofilament yarns 36 and multifilament yarns 38 thus form parts of mother fabric 42. Indeed, as discussed below, multifilament yarns 38 are substituted for certain ones of monofilament yarns 36 as weft yarns 32 are inserted and woven with warp yarns 28, and mother fabric 42 is thereby formed on loom 44. Each child fabric 10A, 10B, 10C, 10D can be custom-sized to have different lengths and widths and a different number of multifilament yarns 38, but each child fabric 10A, 10B, 10C, and 10D has at least one multifilament yarn 38 for forming a seam area 46 and can have two or more such multifilament yarns 38 for forming a plurality of such seam areas 46.

FIG. 10 shows a mother roll layout showing four child fabrics 10A, 10B, 10C, and 10D to be cut out of mother fabric 42. The disclosure herein with respect to PMC base fabric 10 applies to each of child fabrics 10A, 10B, 10C, and 10D. The warp and weft yarns 28 and 32 are shown schematically at various portions in FIG. 10, but it is understood that warp and weft yarns 28, 32 extend throughout the entire mother fabric 42. Each of the short lines bordering the edge of each child fabric 10A, 10B, 10C, and 10D schematically represents warp and weft yarns 28, 36. For purposes of illustration, these short lines extend toward the inside of the respective child fabric 10A, 10B, 10C, and 10D so as to clearly show the respective child fabric 10A, 10B, 10C, and 10D in the mother fabric 42. Certain weft and/or warp yarns 32, 28 can be marked to indicate the end/border of the respective child fabric 10A, 10B, 10C, 10D (i.e., the final weft or warp yarn 32, 28 along a particular edge of the respective child fabric), and certain wefts 32 can be marked for folding. Various multifilament yarns 38 are shown at predetermined locations in the mother fabric 42 and are shown extending across the transverse width of mother fabric 42 in cross machine direction 34. The material of mother fabric 42 that is not included in a child fabric 10A, 10B, 10C, 10D can be considered waste material 48. It is understood that the child fabrics 10A, 10B, 10C, 10D are cut out of mother fabric 42 and marker yarns can be used for such cutting. Thus, each child fabric 10A, 10B, 10C, 10D can be cut from mother fabric 42 at predetermined locations, and each child fabric 10A, 10B, 10C, 10D can be folded at predetermined locations to form the one or more seam loops 12 of the respective child fabric 10A, 10B, 10C, 10D. While FIG. 10 indicates (schematically) that a single cut line is used to separate adjacent child fabrics 10 (i.e., fabrics 10A and 10C), two such spaced apart cut lines (i.e., two parallel, transversely extending cut lines) can be used to make the separation. Certain ones of the multifilament yarns 38 can be used to form a respective seam loop 12 of the respective child fabric 10A, 10B, 10C, 10D. For instance, child fabric 10C shows one multifilament yarn 38 (labeled as 38C-1) near one end of child fabric 10C, multifilament yarn 38C-1 to be used to form a first seam loop 12 of child fabric 10C. Child fabric 10C shows another multifilament yarn 38 (labeled as 38C-2) near the center of child fabric 10C, multifilament yarn 38C-2 to be used to form a second seam loop 12 of child fabric 10C. To form each seam loop 12, the fabric 10 will be folded at predetermined locations near the respective multifilament yarn 38 used in that respective seam area 46. For instance, the two seam loops of fabric 10C will be folded near multifilament yarn 38C-1 to form one seam loop 12 and will be folded near multifilament yarn 38C-2 to form the other seam loop 12 of fabric 10C. Child fabric 10D also shows multifilament yarns 38 (labeled as 38D-1 and 38D-2) that will be used to form first and second seam loops 12 of child fabric 10D; these seam loops 12 will be formed by folding fabric 10D near multifilament yarns 38D-1 and 38D-2, as indicated in FIGS. 1 and 3-8. Although multifilament yarns 38D-1 and 38D-2 also extend across fabric 10C, multifilament yarns 38D-1 and 38D-2 do not form a part of a seam loop 12 of fabric 10C.

Referring to FIG. 11, after cutting the respective child fabric 10 from mother fabric 42, during a process for preparing a seam area 46 of PMC base fabric 10, a plurality of adjacent weft yarns 36 (and conceivably also a multifilament yarn 38 if there is an extra multifilament yarn 38 in the seam area 46 of a respective child fabric 10A, 10B, 10C, 10D) are removed from PMC base fabric 10 to define a window of warp yarns 28 not interwoven with weft yarns 32. In the illustrated embodiment, window is defined by a plurality of weft yarns 36 (i.e., four such weft yarns 36) which are removed from PMC base fabric 10; a different number of weft yarns 36 could be removed, such as one to eight (or more) weft yarns 36. Marker yarns can be used, for example, to define the anticipated seam area 46; for example, the weft yarns 36 that are to be removed can be marked for removal prior to removal. A window 40 can, for example, be about four millimeters, and the distance between adjacent windows 40 of base fabric 10 can be about twenty meters. On either side of window 40, a plurality of warp yarns 28 are interwoven with a plurality of weft yarns 32 to include a plurality of monofilament yarns 36 at least one multifilament yarn 38. The portion of the non-woven warp yarns 28 within window 40 are used to define the seam loops 12 at the seam area 46 of PMC base fabric 10. Thus, the process according to the present invention includes removing certain adjacent ones of weft yarns 36 from fabric 10 to define at least one window 40 of warp yarns 28 not interwoven with weft yarns 32, warp yarns 28 being interwoven with weft yarns 36, 38 on opposite sides of window 40, the at least one multifilament yarn 38 being immediately adjacent the at least one window 40. FIG. 11 thus shows an anticipated seam area 46 of the PMC base fabric 10 and that window 40 is bordered by a multifilament yarn 38 on one side and a first weft yarn 36 (monofilament yarn 36) on the other side of window 40.

Further, the step of folding includes folding over fabric 10 at the at least one window 40. FIGS. 1 and 3-8 show fabric 10 having been folded. Thus, when in a folded state, the portion of PMC base fabric 10 defined by window 40 forms a respective seam loop 12. Opposing seam loops 12 of the same base fabric 10 can be aligned and interdigitated, and a pintle wire (not shown) can be inserted through the seam loops 12 to define the seam.

The process according to the present invention further includes attaching together, after the step of folding, a portion of fabric 10 adjacent the at least one window 40. Prior to insertion of the pintle wire, the portion of PMC base fabric 10 adjacent window 40 can be bonded together. The bonding may be carried out using sewing, ultrasonic welding, heat sealing, and/or gluing. In the illustrated embodiments in FIGS. 3-8, the bonding is by sewing with one or more rows of stitches extending parallel to weft yarns 32 in cross machine direction 34. Thus, the step of attaching together can include at least one of stitching, sewing, ultrasonic welding, heat sealing, gluing, laser welding, and melt bonding. In this way, top ply 18 and bottom ply 20 can be secured to one another in seam area 46 using reinforcement 24. FIGS. 3-8 show the seam area 46 as including reinforcements 24, which can be in the form of seam stitching 24. The vertical line in FIG. 3 provides that the seam stitching 24 extends in cross machine direction 34 and is positioned between at least one multifilament yarn 38 and an immediately following one of first weft yarns 36 (monofilament yarns 36) on a sheet side 14 of the PMC base fabric 10 in a direction 50 facing away from the at least one window 40; thus, one or more stitches 24 can be placed at this location. Similarly, the reinforcement 24 in FIG. 4 can be placed between multifilament yarn 38 and the next adjacent monofilament yarn 36 on sheet side 14. Alternatively, the vertical line in FIG. 5 provides that the seam stitching 24 extends in cross machine direction 34 and is positioned after at least one multifilament yarn 38 and an immediately following one of first weft yarns 36 (monofilament yarns 36) on a sheet side 14 of the PMC base fabric 10 in direction 50 facing away from the at least one window 40 and before a next immediately following one of first weft yarns 36 (monofilament yarns 36) on a sheet side 14 of the PMC base fabric 10 in direction 50 facing away from the at least one window 40; thus, one or more stitches 24 can be placed at this location. Similarly, the reinforcement 24 in FIGS. 5-8 can be placed between the first monofilament yarn 36 and the second monofilament yarn 36 on sheet side 14.

Moreover, stitches/reinforcements 24 may be placed at alternative or additional locations. The sewing may be carried out using a lock stitch, chain stitch, bag stitch, back stitch, cable stitch, cover stitch, overcast stitch, an over seam stitch, or any other suitable stitch. The sewing may be applied as a straight stitch, zig-zag stitch, double needle stitch, or multi-needle stitch, for example. The yarn used for the stitches may be a cabled yarn, multifilament yarn, monofilament yarn, knitted yarn, spun fiber yarn, texturized yarn, thermal bonded yarn, low twisted yarn, plied yarn, twisted yarn, soluble yarn, thread or melting yarn. Other common types of yarn used for stitches are also possible.

Figure 8:
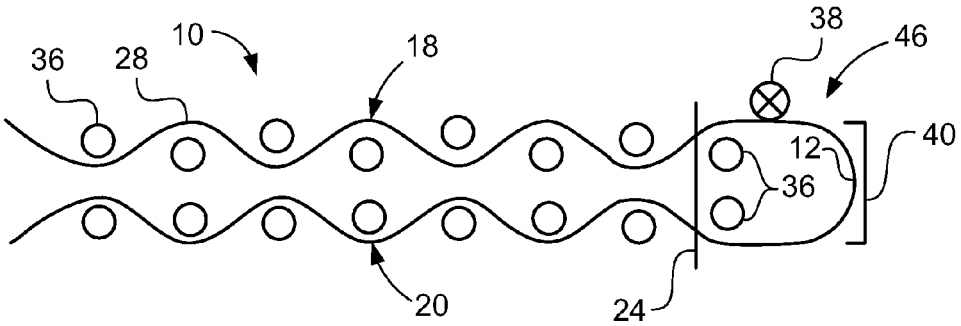
FIG. 8 is a side view of a portion of another embodiment of the PMC base fabric of FIG. 1.

According to another embodiment of the present invention, the present invention provides a process for preparing a seam area 46 for PMC base fabric 10. The process includes the steps of: forming the PMC base fabric 10 by flat-weaving, the PMC base fabric 10 including a plurality of warp yarns 28 extending in a machine direction 30 and a plurality of weft yarns 32 extending in a cross machine direction 34 and interwoven with said plurality of warp yarns 28, weft yarns 32 including a plurality of first weft yarns 36 and at least one second weft yarn 38, the at least one second weft 38 yarn being a specialty yarn 38 (as described above), warp yarns 28, first weft yarns 36, and the at least one specialty yarn 38 being woven together on a loom 44 in an original weaving process, the at least one specialty yarn being at a position associated with an anticipated seam area 46 (examples of such a position associated with an anticipated seam area 46 are shown in FIG. 10); and folding over the PMC base fabric 10, after weaving the at least one specialty yarn 38 with warp yarns 28, to form a seam loop 12 of the PMC base fabric 10 such that the at least one specialty yarn 38 is at a position associated with said seam loop 12 (examples of such a position associated with the seam loop are shown in FIG. 8). The at least one specialty yarn can be a multifilament yarn, a plurality of filaments that have been extruded together, a cabled monofilament yarn, a cabled multifilament yarn, a staple yarn, a colored multifilament yarn, or a colored monofilament yarn (as described above). Fabric 10 is a child fabric 10 (for example, 10A, 10B, 10C, 10D) formed from a flat-woven mother fabric 42 which includes a plurality of the child fabric 10 (for example, 10A, 10B, 10C, 10D) for forming individual ones of the PMC base fabric 10, mother fabric 42 thereby including a plurality of the specialty yarn (for example, but not by way of limitation, multifilament yarn 38) interwoven during the original weaving process. First weft yarns 36 can be a plurality of monofilament yarns 36 (which are not cabled) and/or a plurality of cabled monofilament yarns. Further, the at least one specialty yarn 38 can be two or more specialty yarns 38 (that is, two or more specialty yarns 38 can be provided rather than only one); the process of the present invention can further include the step of adding at least two specialty yarns 38 into the same shed during the original weaving process on the loom (as mentioned above, the specialty yarns 38 can optionally be multifilament yarns 38). This can result in the at least two specialty yarns 38 being adjacent one another in the weave.

In summary, the present invention provides a method for improving seam quality of a base fabric 10 (such as a JAX base fabric). According to the present invention, flat-woven mother rolls 42 (which can also be referred to as mother fabrics 42) are planned to the pick before weaving such that the size and number of picks of each child fabric 10 is determined. The location of each seam (seam areas 46) in each child fabric 10 is then calculated (along with the Single Layer Joins, that is, where the free ends 22 of the base fabric 10 come together and are joined together). A data file that specifies the picks where specialty yarns (for example, but not by way of limitation, the multifilament yarns 38) are desired are loaded into the loom 44. The loom 44 is programmed to substitute the specialty yarn 38 into the repeating pattern at the specified picks. The base fabric 10 is then processed so that the specialty yarn 38 ends up as the first cross machine direction yarn 32 on the sheet side 14 of each set of seam loops 12. The seam stitching 24 can be located after the multifilament yarn 38 or after the first monofilament yarn 36 on the sheet side 14.

According to one embodiment of the process according to the present invention, a felt (such as PMC base fabric 10) with a design length of 18.52 meter (m) is woven at 750 picks/m. The start of the fabric 10 is at pick number 375, and the first set of seam loops 12 (that is, the anticipated location of the first set of seam loops 12 that will be formed) is located at pick number 14972. This pick (pick number 14972) would be made with the multifilament yarn 38. The second set of seam loops 12 would be located at pick number 29001. This pick (pick number 29001) would also be a multifilament yarn 38. A flat-woven mother roll 42 can have, for example, two to eight child base fabrics 10 cut out of the mother roll 42 (that is, the mother fabric 42). Each child fabric 10 can have two sets of seam loops 12. All locations of seams (that is, seam areas 46) throughout the mother roll 42 are calculated and the multifilament yarns 38 are woven in at these locations during the original weaving process forming the mother fabric 42. This embodiment is provided by way of example and not by way of limitation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for preparing a seam area for a paper machine clothing (PMC) base fabric, said process comprising the steps of:

forming the PMC base fabric by flat-weaving, the PMC base fabric including a plurality of warp yarns extending in a machine direction and a plurality of weft yarns extending in a cross machine direction and interwoven with said plurality of warp yarns, said plurality of weft yarns including a plurality of first weft yarns and at least one second weft yarn, said at least one second weft yarn being a multifilament yarn that is different from said plurality of first weft yarns, said plurality of warp yarns, said plurality of first weft yarns, and said at least one multifilament yarn being woven together on a loom in an original weaving process, said at least one multifilament yarn being positioned in an anticipated said seam area; and folding over the PMC base fabric, after weaving said at least one multifilament yarn with said plurality of warp yarns, to form a seam loop of the PMC base fabric such that said at least one multifilament yarn is a first one of said plurality of weft yarns on a sheet side of said seam loop.

2. The process according to claim 1, wherein said at least one multifilament yarn is formed by one of (a) a plurality of filaments that have been extruded together, (b) a cabled monofilament yarn, (c) a cabled multifilament yarn, (d) a staple yarn, and (e) a colored multifilament yarn.

3. The process according to claim 2, further including removing certain adjacent ones of said plurality of weft yarns from said fabric to define at least one window of said plurality of warp yarns not interwoven with said plurality of weft yarns, said plurality of warp yarns being interwoven with said plurality of weft yarns on opposite sides of said at least one window, said at least one multifilament yarn being immediately adjacent said at least one window.

4. The process according to claim 3, wherein said step of folding includes folding over said fabric at said at least one window.

5. The process according to claim 4, further including attaching together, after said step of folding, a portion of said fabric adjacent said at least one window.

6. The process according to claim 5, wherein said step of attaching together includes at least one of stitching, sewing, ultrasonic welding, heat sealing, gluing, laser welding, and melt bonding.

7. The process according to claim 6, wherein said stitching extends in said cross machine direction and is positioned between said at least one multifilament yarn and an immediately following one of said plurality of first weft yarns on a sheet side of the PMC base fabric in a direction facing away from said at least one window.

8. The process according to claim 6, wherein said stitching extends in said cross machine direction and is positioned after said at least one multifilament yarn and an immediately following one of said plurality of first weft yarns on a sheet side of the PMC base fabric in a direction facing away from said at least one window and before a next immediately following one of said plurality of first weft yarns on a sheet side of the PMC base fabric in said direction facing away from said at least one window.

9. The process according to claim 5, wherein said fabric is a child fabric formed from a flat-woven mother fabric which includes a plurality of said child fabric for forming individual ones of the PMC base fabric, said mother fabric thereby including a plurality of said multifilament yarn interwoven during said original weaving process.

10. The process according to claim 1, wherein said plurality of first weft yarns are at least one of a plurality of monofilament yarns and a plurality of cabled monofilament yarns.

11. The process according to claim 1, wherein said fabric is a single-layered fabric prior to said step of folding.

12. The process according to claim 1, wherein said at least one multifilament yarn is two of said multifilament yarn, the process further including adding said two multifilament yarns into a same shed during said original weaving process on said loom.

13. A process for preparing a seam area for a paper machine clothing (PMC) base fabric, said process comprising the steps of:

forming the PMC base fabric by flat-weaving, the PMC base fabric including a plurality of warp yarns extending in a machine direction and a plurality of weft yarns extending in a cross machine direction and interwoven with said plurality of warp yarns, said plurality of weft yarns including a plurality of first weft yarns and at least one second weft yarn, said at least one second weft yarn being a specialty yarn that is different from said plurality of first weft yarns, said plurality of warp yarns, said plurality of first weft yarns, and said at least one specialty yarn being woven together on a loom in an original weaving process, said at least one specialty yarn being at a position associated with an anticipated said seam area; and folding over the PMC base fabric, after weaving said at least one specialty yarn with said plurality of warp yarns, to form a seam loop of the PMC base fabric such that said at least one specialty yarn is at a position associated with said seam loop.

14. The process according to claim 13, wherein said at least one specialty yarn is formed by one of (a) a multifilament yarn, (b) a plurality of filaments that have been extruded together, (c) a cabled monofilament yarn, (d) a cabled multifilament yarn, (e) a staple yarn, (f) a colored multifilament yarn, and (g) a colored monofilament yarn.

15. The process according to claim 14, wherein said fabric is a child fabric formed from a flat-woven mother fabric which includes a plurality of said child fabric for forming individual ones of the PMC base fabric, said mother fabric thereby including a plurality of said multifilament yarn interwoven during said original weaving process.

16. The process according to claim 13, wherein said plurality of first weft yarns are at least one of a plurality of monofilament yarns and a plurality of cabled monofilament yarns.

17. The process according to claim 13, wherein said at least one specialty yarn is two of said specialty yarn, the process further including adding said two specialty yarns into a same shed during said original weaving process on said loom.

* * * * *